US008870042B2

(12) United States Patent
Clifton

(10) Patent No.: US 8,870,042 B2
(45) Date of Patent: Oct. 28, 2014

(54) HOLSTER ASSEMBLY AND RELATED METHODS

(76) Inventor: Norman E. Clifton, Jacksonville, FL (US)

( * ) Notice: Subject to any disclaimer, the term of this patent is extended or adjusted under 35 U.S.C. 154(b) by 504 days.

(21) Appl. No.: 13/142,796

(22) PCT Filed: Dec. 29, 2009

(86) PCT No.: PCT/US2009/069678

§ 371 (c)(1),
(2), (4) Date: Jun. 29, 2011

(87) PCT Pub. No.: WO2010/078318

PCT Pub. Date: Jul. 8, 2010

(65) Prior Publication Data

US 2011/0266317 A1 Nov. 3, 2011

Related U.S. Application Data

(60) Provisional application No. 61/203,796, filed on Dec. 29, 2008.

(51) Int. Cl.
*F41C 33/02* (2006.01)
*F41C 33/04* (2006.01)
*A45F 5/02* (2006.01)

(52) U.S. Cl.
CPC ..... *F41C 33/0227* (2013.01); *F41C 33/041* (2013.01); *A45F 5/021* (2013.01); *A45F 5/02* (2013.01); *F41C 33/0263* (2013.01); *A45F 2200/0591* (2013.01); *Y10S 224/912* (2013.01)
USPC ..... 224/243; 224/198; 224/912

(58) Field of Classification Search
USPC ..... 224/242, 243, 192, 193, 198, 911, 244, 224/912
See application file for complete search history.

(56) References Cited

U.S. PATENT DOCUMENTS

| | | | | |
|---|---|---|---|---|
| 4,912,867 | A * | 4/1990 | Dukes, Jr. | 42/70.11 |
| 5,284,281 | A * | 2/1994 | Nichols | 224/244 |
| 5,918,784 | A * | 7/1999 | Serpa | 224/244 |
| 7,434,712 | B2 * | 10/2008 | Cook et al. | 224/243 |
| 7,461,765 | B2 * | 12/2008 | French et al. | 224/243 |
| 7,556,181 | B2 * | 7/2009 | Spielberger | 224/244 |
| 7,562,797 | B2 * | 7/2009 | Senn et al. | 224/243 |
| 7,584,875 | B2 * | 9/2009 | Lowe et al. | 224/243 |
| 7,819,294 | B2 * | 10/2010 | Lowe et al. | 224/243 |
| 7,841,497 | B1 * | 11/2010 | Gregory et al. | 224/243 |
| 7,950,553 | B2 * | 5/2011 | Rassias | 224/243 |
| 8,177,108 | B1 * | 5/2012 | Kincaid et al. | 224/243 |

(Continued)

*Primary Examiner* — Justin Larson
*Assistant Examiner* — Lester L Vanterpool
(74) *Attorney, Agent, or Firm* — Arthur G. Yeager

(57) ABSTRACT

Holster assembly has elongated retainer body having elongated axis and including spaced sidewalls to accommodate weapon upper portion therebetween, and connecting wall bridging the spaced sidewalls, retaining arms each having retaining arm first end engagable with recessed weapon area in the weapon upper portion, and a second end, the retaining arms being pivotally mounted to the retainer body between each retaining arm ends, and elongated operating lever extending parallel to the axis and having operating lever first end, adapted for manipulation by user, and operating lever second end, the operating lever being pivotally mounted to and between the sidewalls of the retainer body between the operating lever ends and operable to selectively position the operating lever second end to impede and allow pivoting of the retaining arms. Cowling adjacent lever first end to protect the upper end of the weapon and several safety features are shown.

17 Claims, 7 Drawing Sheets

(56) References Cited

U.S. PATENT DOCUMENTS

| | | | | |
|---|---|---|---|---|
| 8,235,263 | B1 * | 8/2012 | Yeates et al. | 224/243 |
| 8,474,670 | B1 * | 7/2013 | Gregory et al. | 224/243 |
| 8,631,981 | B2 * | 1/2014 | Zusman | 224/244 |
| 8,720,755 | B2 * | 5/2014 | Gregory et al. | 224/244 |
| 2002/0047029 | A1 * | 4/2002 | Liao | 224/244 |
| 2005/0035163 | A1 * | 2/2005 | French et al. | 224/243 |
| 2005/0040195 | A1 * | 2/2005 | Lowe et al. | 224/243 |
| 2005/0279788 | A1 * | 12/2005 | Lowe et al. | 224/244 |
| 2006/0156525 | A1 * | 7/2006 | Jenkins et al. | 29/407.1 |
| 2008/0179360 | A1 * | 7/2008 | Lowe et al. | 224/243 |

* cited by examiner

FIG. 4
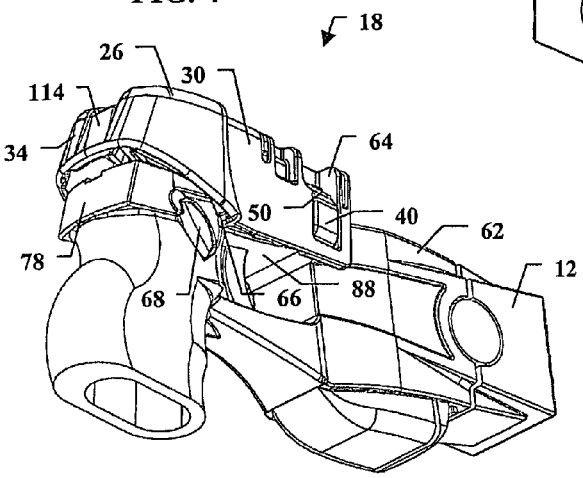
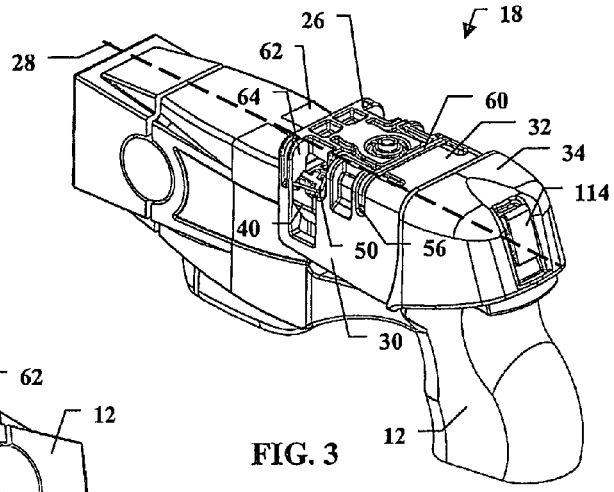
FIG. 3
FIG. 5
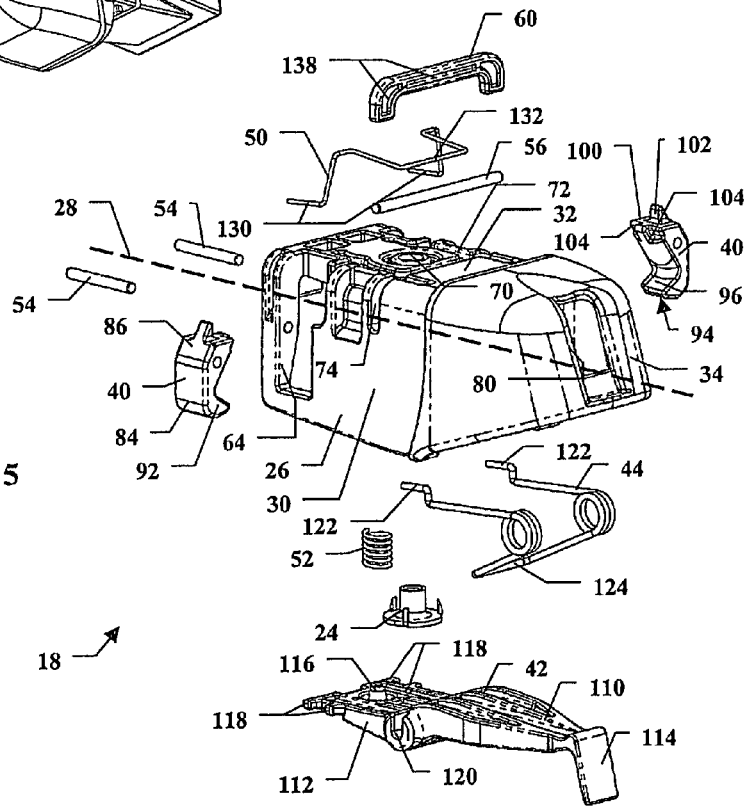

HOLSTER ASSEMBLY AND RELATED METHODS

CROSS-REFERENCE TO RELATED APPLICATION

This application claims the benefit of U.S. Provisional Application Ser. No. 61/203,796, filed on Dec. 29, 2008, the contents of which application are hereby incorporated by reference in their entirety.

FIELD OF THE INVENTION

The present invention relates to holsters and methods for use, and more particularly to holsters for releasably securing electroshock weapons.

BACKGROUND OF THE INVENTION

The use of holsters to hold firearms and other weapons when not actively in use is well known. In general, design objectives of holsters include securely and unobtrusively holding the weapon when it is not wanted and allowing the weapon to be quickly and reliably drawn when it is wanted. Exemplary holsters designed to meet these design objectives can be seen in U.S. Pat. No. 5,100,036, U.S. Pat. No. 5,018,654 and U.S. Pat. No. 5,275,317.

Despite the advantages offered by such holsters, further improvements are possible. Additionally, with the increasing prevalence of electroshock weapons, which disrupt the muscle control of a target, inflict shock-related pain, or both, improvements to holster design can be made that are tailored to such weapons.

SUMMARY OF THE INVENTION

In view of the foregoing, it is an object of the present invention to provide an improved holster assembly and related methods. It is a further object of the present invention to provide a holster assembly that is particularly well-suited for use with electroshock weapons.

According to an embodiment of the present invention, a weapon holster assembly includes a retainer assembly and a holster pocket. The retainer assembly includes a retainer body having first and second sidewalls spaced apart to accommodate a weapon upper portion therebetween and having respective first and second retaining arm openings defined therein, a connecting wall bridging the first and second sidewalls, and a first safety protrusion positioned to a engage a weapon safety operator, such that the weapon safety operator is urged into a "safe" position when inserting the weapon upper portion between the first and second sidewalls and to retain the weapon safety operator in the "safe" position while the weapon upper portion is positioned therebetween.

The retainer assembly also includes first and second retaining arms, each having a retaining arm first end, adapted to engage at least one recessed weapon area associated with the weapon upper portion, and a retaining arm second end, the first and second retaining arms being pivotally mounted in the respective first and second retaining arm openings between the retaining arm first and second ends, and an operating lever having an operating lever first end, including a thumb tab extending generally perpendicular from the operating lever, and an operating lever second end, the operating lever being pivotally mounted to the first and second sidewalls between the operating lever first and second ends and operable to selectively position the operating lever second end to impede and allow pivoting of the first and second retaining arms. An operating lever biasing element urges the operating lever into engagement with the first and second retaining arm second ends.

The holster pocket extends from, and releasably connects to, the retainer body and allows insertion of a front end of the weapon upper portion therein.

According to a method aspect, a method for using a weapon holster assembly, the method includes positioning a weapon upper portion between opposed sidewalls of a retainer body such that a retaining arm mounted to the retainer body pivots into engagement with a recessed weapon area and an operating lever mounted to the retainer body pivots into position to impede disengagement of the retaining arm. The operating lever is manually pivoted to allow disengagement of the retaining arm, and the weapon upper portion is removed from the between the opposed sidewalls of the retainer body such that the retaining arm is pivoted out of engagement with the recessed weapon area.

These and other objects, aspects and advantages of the present invention will be better appreciated in view of the drawings and following detailed description of preferred embodiments.

BRIEF DESCRIPTION OF THE DRAWINGS

FIG. 3 is a top perspective view of the retainer assembly of FIG. 1, on a weapon in a locked configuration;

FIG. 4 is a bottom perspective view of the retainer assembly of FIG. 1, on a weapon in an unlocked configuration;

FIG. 5 is an exploded, perspective view of the retainer assembly of FIG. 1;

DETAILED DESCRIPTION OF PREFERRED EMBODIMENTS

Figure 1:
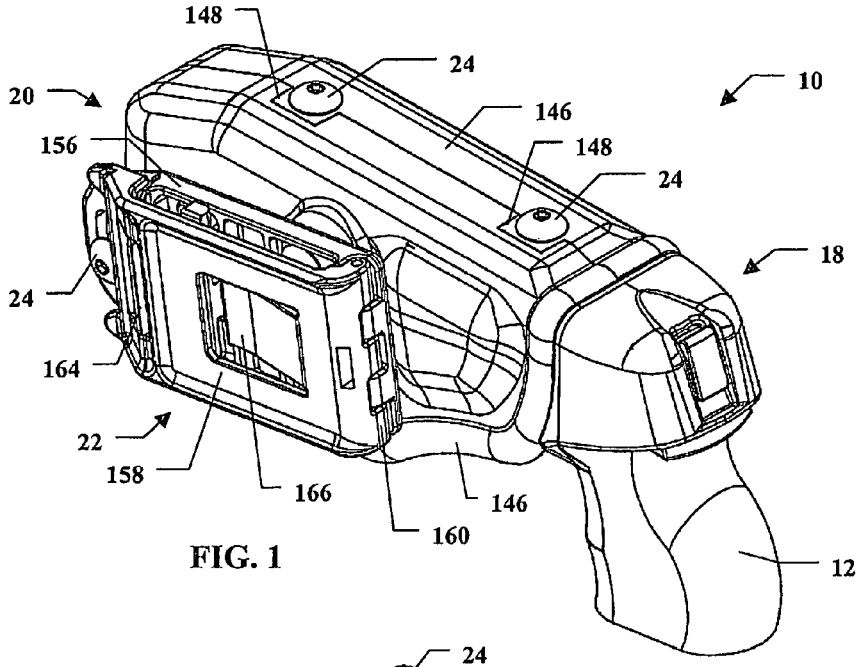
FIG. 1 is a top perspective view of a holster assembly and a weapon, including a retainer assembly, according to an embodiment of the present invention.
Figure 2:
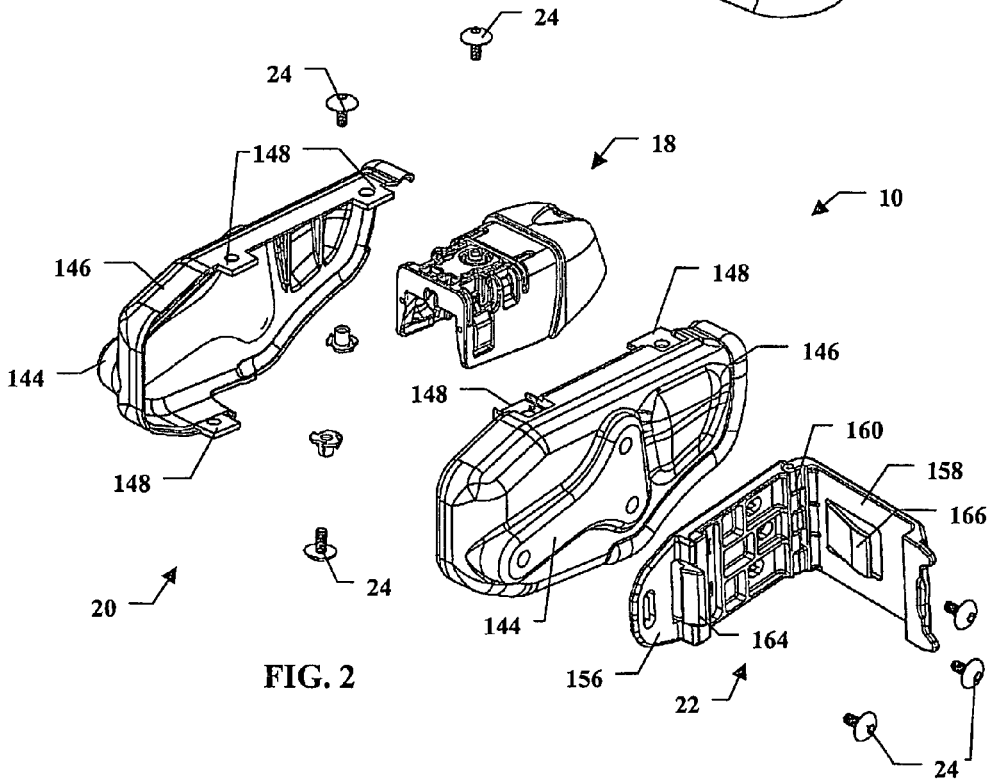
FIG. 2 is a partially exploded, perspective view of the holster assembly of FIG. 1.

Referring to FIGS. 1 and 2, according to an embodiment of the present invention, a holster assembly 10 for a weapon 12 includes a retainer assembly 18, a holster pocket 20 and a belt clip 22. The retainer assembly 18, holster pocket 20 and belt clip 22 are releasably connected by a plurality of fasteners 24, for example, screws and related anchors. The retainer assembly 18 and holster pocket 20 cooperate to releasably secure the weapon 12 therein, and the belt clip 22 is operable to releasably secure the retainer assembly 18 and holster pocket 20 to a user's belt, harness or the like. The depicted weapon 12 is an electroshock weapon, although the present invention is not necessarily limited thereto.

Referring to FIGS. 3-5, the retainer assembly 18 includes a retainer body 26 extending along an elongated axis 28 and having a pair of substantially opposed sidewalls 30 bridged by a connecting wall 32, with a cowling 34 extending from adjacent rear edges of the sidewalls 30 and connecting wall 32. The retainer assembly 18 further includes a pair of pivotally mounted retaining arms 40, a pivotally mounted operating lever 42 and a weapon release biasing element 44, as well as retaining arm and operating lever biasing elements 50, 52 and pivot pins 54, 56. The retainer assembly 20 additionally includes a biasing element clip 60. The retainer assembly 20 is generally operable to shift between a locked configuration (see FIG. 3), in which the operating lever 42 substantially impedes pivoting of the retaining arms 40, and an unlocked configuration (see FIG. 4), in which the operating lever 42 allows pivoting of the retaining arms 40.

The sidewalls 30 extend generally parallel to the elongated axis 28 and are spaced apart sufficiently to closely accommodate an upper portion 62 of the weapon 12 therebetween. A retaining arm opening 64 is defined extending through each sidewall 30. The retaining arms 40 are pivotally mounted within the retaining arm openings 64 by the retaining arm pivot pins 54. The retaining arm pivot pins 54 are inserted from front edges of the sidewalls 30 through aligned bores in the sidewalls 30 and the retaining arms 40, and extend substantially parallel to the elongated axis 28. A safety protrusion 66 extends inwardly from each of the sidewalls 30, positioned to engage a safety operator 68 of the weapon 12 when the weapon upper portion 62 is being inserted into the retainer body 26 to cause the weapon to be in the "safe" or deactivated position when fully inserted.

The connecting wall 32 has a fastener bore 70 defined therein, as well as biasing element channels 72 and a clip slot 74. The fastener bore 70 accommodates a T-nut or other fastener 24 therethrough. The biasing element channels 72 contain and guide portions of the weapon release and retaining arm biasing elements 44, 50. The clip slot 74 closely accommodates the biasing element clip 60. Opposite lower ends of the clip slot 74 extend into the sidewalls 30 and accommodate respective ends of the operating lever pivot pin 56 therein, substantially perpendicular to the elongated axis 28.

The cowling 34 is dimensioned to at least partially cover a rear end 78 of the weapon upper portion 62, which may contain a viewing window. An operating lever opening 80 is defined in the back of the cowling 34, through which the operating lever 42 extends.

Each retaining arm 40 includes a first end 84 and a second end 86. The first end 84 is adapted to engage a recessed weapon area 88 associated with the weapon upper portion 62. In the depicted embodiment the recessed weapon area 88 is defined by an upper surface 88A of a trigger guard of the weapon 12. This is particularly advantageous for use with an electroshock weapon, where the trigger is typically located closer to the top of the weapon than in conventional firearms.

Each retaining arm first end 84 includes a retaining tooth 92. The retaining tooth 92 has first tooth face 94, arranged at an acute angle from the retaining arm 40, and a second tooth face 96, extending substantially perpendicularly from the retaining arm 40. Each retaining arm second end 86, includes an upper surface 100 from which a retaining arm biasing element tab 102 upwardly extends. Second end recesses 104 extend downwardly from the upper surface 100.

The operating lever 42 extends substantially parallel to the elongated axis 28 between first and second ends 110, 112 and is pivotally mounted to the sidewalls 30 by the operating lever pivot pin 56. The first operating lever end 110 includes a thumb tab 114 extending generally perpendicular to the rest of the operating lever 42 and through the operating lever opening 80 of the cowling 34. The second end 112 includes an operating lever biasing element seat 116 extending upwardly therefrom and a plurality of protrusions 118 extending outwardly from opposing sides thereof. The operating lever pivot pin 56 extends through a pivot pin bore 120 between the first and second ends 110, 111.

The weapon release biasing element 44 is preferably a torsion spring formed from a single wire, having a pair of free ends 122 that are seated in biasing element channels 72 of the connecting wall 32 and engaged by the biasing element clip 60. A weapon engagement loop 124 depends downwardly from the free ends 122.

The retaining arm biasing element 50 is a single wire spring having free ends 130 and a central portion 132. The free ends 130 extend across respective retaining arm openings 64 and engage the retaining arm second ends 86 to urge them inwardly. In at least the locked position of the retainer assembly 18, the free ends 130 particularly engage the retaining arm biasing element tabs 102. The central portion 132 extends into the biasing element channels 72 of the connecting wall 32 and crosses the connecting wall 32 in the clip slot 74. The biasing element clip 60 engages the central portion 132 in the clip slot 74.

The operating lever biasing element 52 is a compression spring. The operating lever biasing element 52 is arranged on the operating lever biasing element seat 116 and urges the second end 112 of the operating lever 42 downwardly away from the connecting wall 32.

The biasing element clip 60 is generally U-shaped and includes recesses 138 formed on both sides thereof. The free ends 122 of the weapon release biasing element 44 and the central portion 132 of the retaining arm biasing element 50 extend into the recesses 138 with the clip 60 in position in the clip slot 74. The biasing element clip 60 can releasably snap-fit into the clip slot 74.

Figure 7:
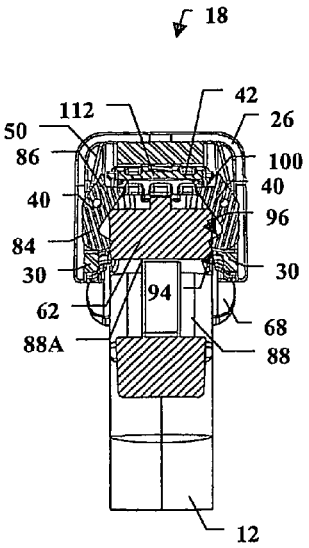
FIG. 7 is a sectional view taken along line 7-7 of FIG. 6.
Figure 6:
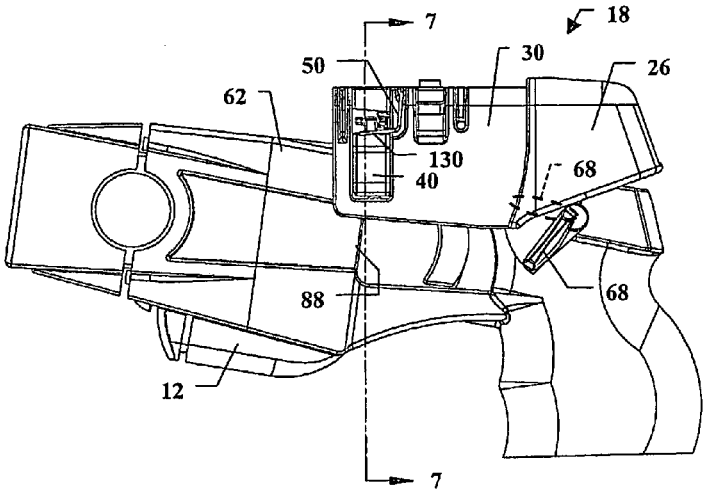
FIG. 6 is a side elevational view of the retainer assembly of FIG. 4.
Figure 8:
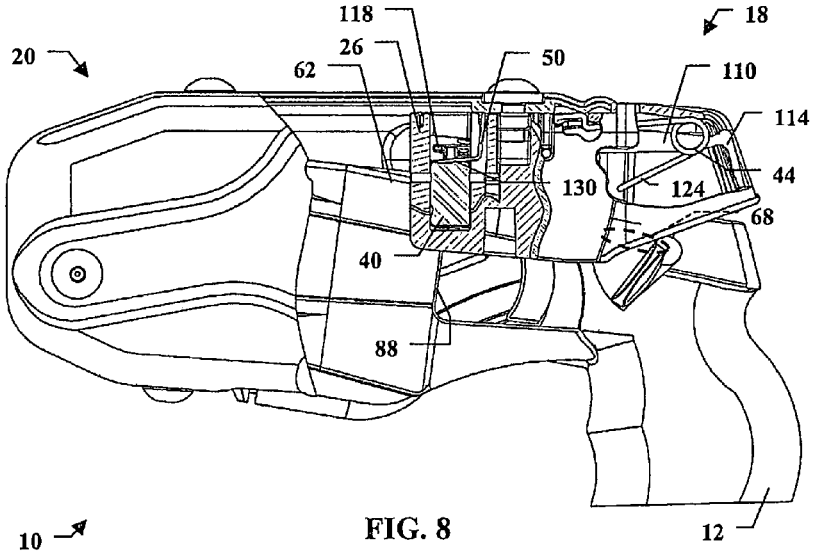
FIG. 8 is a side elevational view of the holster assembly of FIG. 1, including the retainer assembly on a weapon in an unlocked configuration, with components partially cut-away to show details.

Referring to FIGS. 6-8, in operation of the retainer assembly 18, the weapon 12 is inserted into the holster pocket 20 and pivoted to move the weapon upper portion 62 between the sidewalls 30. Advantageously, the holster pocket 20 is dimensioned to limit downward insertion such that the recessed weapon area 88 will be properly aligned for subsequent engagement by the retaining arms 40.

As the weapon upper portion 62 is pivoted into position between the sidewalls 30, the upper portion 62 contacts the first tooth faces 94 of the retaining arms 40, urging the retaining arms first ends 84 outward. In FIGS. 6-8, the operating lever 42 is shown to be manually pivoted out of engagement with the retaining arms 40. However, it will be appreciated that with the operating lever 42 not being manually operated and engaging the upper surfaces 100 of the retaining arms 40, the retaining arm second ends 86 can still pivot inwards under the operating lever 42. Thus, manual operation of the operating lever 42 is generally not required to insert the weapon 12 into the retainer body 20.

If the safety operator 68 of the weapon 12 is in the activated or "fire" position (shown in broken lines in FIGS. 6 and 8), the safety operator 68 will be engaged by the safety protrusions 66 (see FIG. 4) extending from the sidewalls 30 and urged into, and maintained in, the deactivated or "safe" position, when the weapon upper portion 62 is moved into the retainer body 26.

Figure 10:
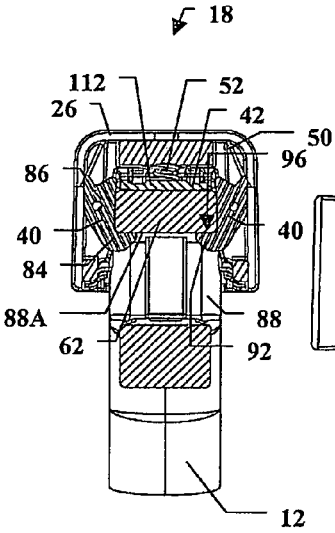
FIG. 10 is a sectional view taken along line 10-10 of FIG. 9.
Figure 9:
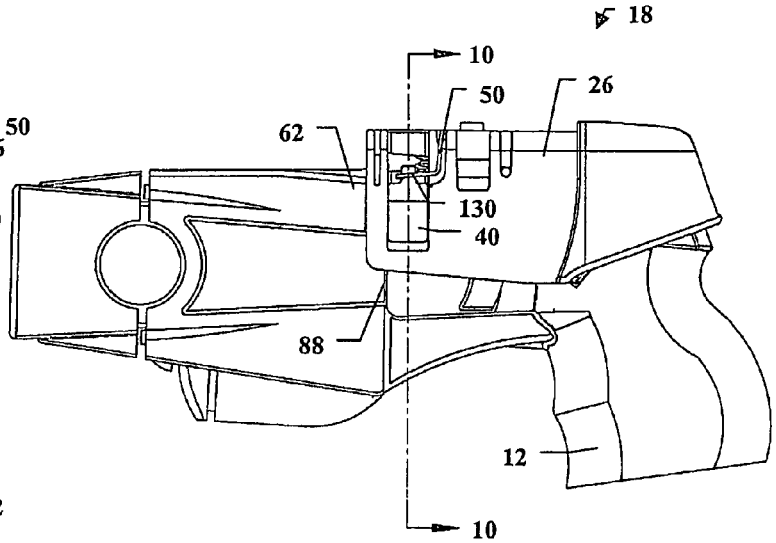
FIG. 9 is a side elevational view of the retainer assembly of FIG. 3.
Figure 11:
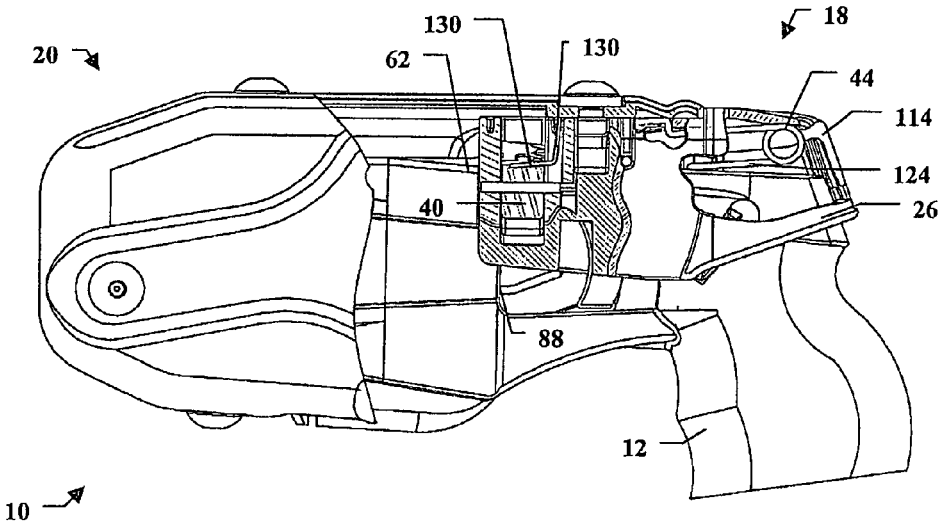
FIG. 11 is a side elevational view of the holster assembly of FIG. 1, including the retainer assembly on a weapon in a locked configuration, with components partially cut-away to show details.

As insertion of the weapon upper portion 62 continues, the upper portion 62 contacts the second retaining arm ends 86, urging the second ends 86 outward and the first retaining arm ends 84 inward. Referring to FIGS. 9-11, once the retaining teeth 92 clear the upper portion 62, the pressure exerted on the second ends 86 urges the teeth 92 to pivot inwardly into the recessed weapon area 88, where the second tooth faces 96 engage the upper portion 62.

The outward pivoting of the second ends 86 move the upper surfaces 100 out from under the operating lever 42. Provided that the operating lever 42 is not being manually held by a user, the operating lever second end 112 is urged by the operating lever biasing element 52 between the second ends 86. In particular, the protrusions 118 of the operating lever second end 112 engage the second end recesses 104 (see FIG. 5). Accordingly, the second ends 86 are impeded from pivoting inward and the retaining teeth 92 are held in the recessed weapon area 88 in engagement with the upper portion 62.

The weapon engagement loop 124 of the weapon release biasing element 44 is forced upwards by the insertion of the weapon upper portion 62 into the retainer body 26. The corresponding outward pivoting of the second retaining arm ends 86, and particularly the retaining arm biasing element tabs 102, force the free ends 130 of the retaining arm biasing element 50 outwards. The biasing forces exerted by the weapon release and retaining arm biasing elements 44, 50 are insufficient to overcome the interference between the operating lever 42 and the retaining arm second ends 86. Accordingly, the retainer assembly 20 is maintained in the locked position until subsequent user manipulation of the operating lever 42.

Referring again to FIGS. 6-8, when a user depresses the thumb tab 114 of the operating lever first end 110, the operating lever 42 pivots such that the operating lever second end 112 and protrusions 118 move out from between the retaining arm second ends 86. The weapon engagement loop 124 of the weapon release biasing element 44, either alone or together with user movement of the weapon 12, urges the weapon upper portion 62 out of the retainer body 26. The retaining arm first ends 84 are moved apart, allowing complete removal of the weapon 12 from the retainer assembly 18.

Once the weapon upper portion 62 is withdrawn from between the retaining arms 40, the free ends 130 of the weapon release biasing element 50 urge the retaining arm second ends 86 under the operating lever second end 112. Accordingly, when the user releases the thumb tab 114 of the operating lever first end 110 after withdrawal of the weapon 12, the retainer assembly 18 will remain in the unlocked configuration and manual operation of the operating lever 42 will not be required upon reinsertion of the weapon 12.

Referring again to FIGS. 1 and 2, the holster pocket 20 is molded from a rigid plastic material to generally conform to the shape of the weapon 12. As described above, the holster pocket is preferably dimensioned to limit insertion of the weapon 12 to a predetermined point, such that the weapon upper portion 62 (see FIG. 8) will be properly aligned for subsequent engagement by the retainer assembly 18.

The holster pocket 20 releasably attaches to the retainer assembly 18 using at least one of the fasteners 24. Mounting points 144 are formed on opposite sides of the holster pocket 20 for releasable attachment of the belt clip 22. The holster pocket 20 is formed from releasably connected pocket halves 146 having a plurality of overlapping connection tabs 148 through which a portion of the fasteners 24 are inserted. Advantageously, at least one of the fasteners 24 used to connected the pocket halves 146 is also used to secure the retainer assembly 18 to and within the holster pocket 20.

The belt clip 22 includes first and second halves 156, 158 pivotally connected by a hinge 160. The second half 158 can be pivoted away from the first half 156 to allow attachment to a user's belt without the need from prior removal. A latch 164 extends from the first half 156 to releasably secure the first and second halves 156, 158 together around the belt. A tension element 166 depends inwardly from the second half 158 to help prevent unwanted sliding of the belt clip 22 along the user's belt.

It will be appreciated that the holster assembly according to the present invention advantageously allows the secure retention of a weapon in the holster, while permitting relatively rapid and easy release of the weapon when required. Additionally, re-securing of the weapon in the holster assembly can be achieved without additional steps using only natural re-holstering movements. Also, safety is enhanced by the automatic positioning of a safety operator left in the activated position into the deactivated position upon re-holstering, and by the maintenance of the safety operator in the deactivated position while holstered. Moreover, the holster assembly is readily adapted for right- and left-handed users, in standard and cross-draw arrangements.

It will be appreciated that the above embodiment is provided for illustrative and exemplary purposes; the present invention is not necessarily limited thereto. For example, the present invention encompasses embodiments having less than all of the components and features described above, and embodiments including components and features described herein in combination with other elements not specifically described above.

For instance, the retaining assembly 18 can be used in connection with other holster pockets, or in the absence of a holster pocket. Holster pockets can be used with attachment points for belt clips located on only one side. Also, other clips or attachment mechanisms can be employed to secure the retaining assembly, with or without the holster pocket 20, to the belt, harness or other article worn by a user.

Alternate embodiments are described below with further variations falling within the scope of the present invention. In the alternate embodiments, similar components and elements are given the same reference number as in previous embodiments with the addition of one or more prime markings, such as 10' or 10".

Figure 12:
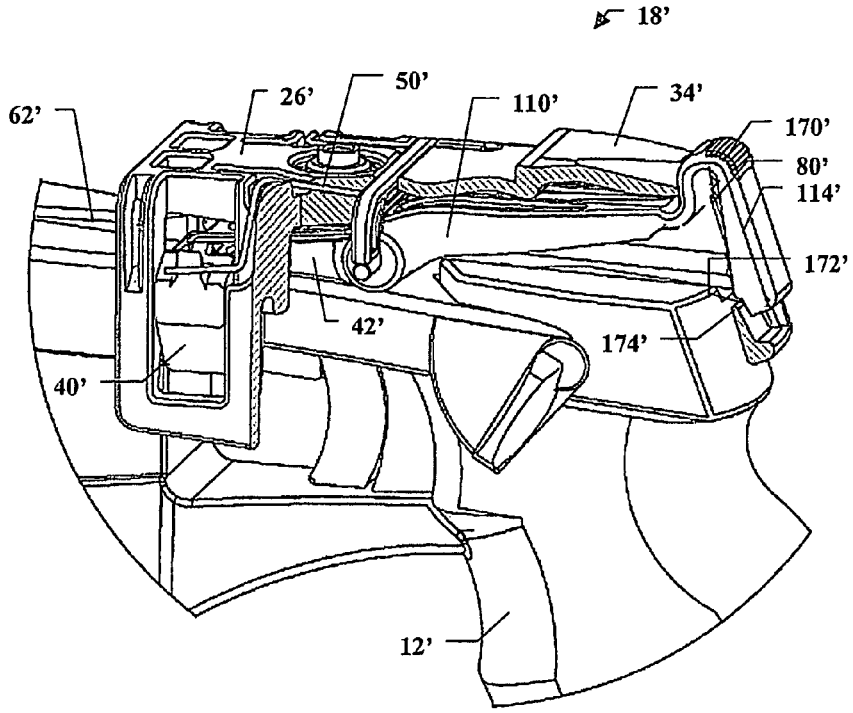
FIG. 12 is a partial top perspective view of a retainer assembly, according to another embodiment of the present invention, on a weapon in a locked configuration, with components partially cut-away to show details.
Figure 13:
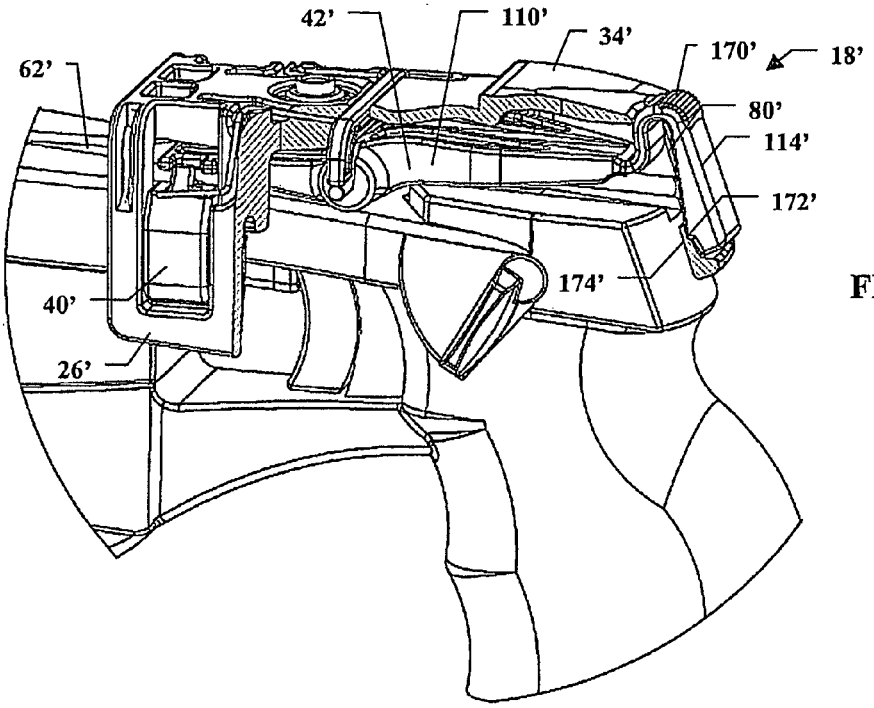
FIG. 13 is a partial top perspective view of the retainer assembly of FIG. 12, on a weapon in an unlocked configuration, with components partially cut-away to show details.

Referring to FIGS. 12 and 13, in an alternate embodiment of the present invention, a retainer assembly 18' includes a retainer body 26' and retaining arms 40' similar to the retainer assembly 18, above. The operating lever 42' has a first end 110' with an enlarged thumb tab 114'. In FIG. 11, the retainer assembly 18' is in the locked configuration. In FIG. 12, the retainer assembly 18' is in the unlocked configuration, with the operating lever 114' manually disengaged from the retaining arms 40' by depressing the first end 110'.

The thumb tab 114' includes a textured surface 170' on an upper end thereof and a notch 172' defined in an inner, lower surface thereof. The notch 172' interacts with a lip 174' of an operating lever opening 80' in a cowling 34' during movement of the thumb tab 114'. As the operating lever first end 110' is depressed using the thumb tab 114', an audible indication will be generated by the interaction. The audible indication will recur when the operating lever first end 110' is released and thumb tab 114' moves upwards.

Figure 14:
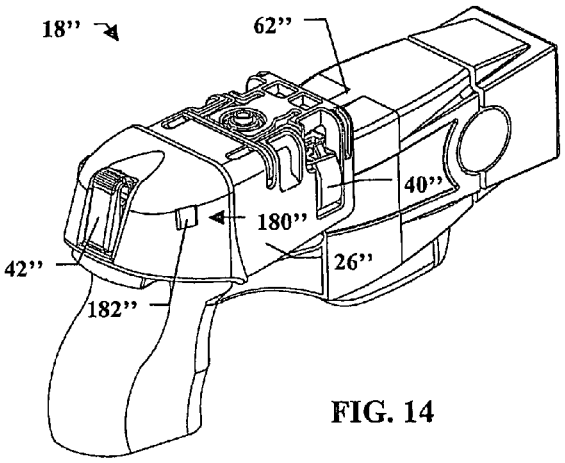
FIG. 14 is a top perspective view of a retainer assembly, according to a further embodiment of the present invention, including an operating lever blocking mechanism.

Referring to FIG. 14, in another embodiment of the present invention, a retainer assembly 18" includes a retainer body 26", retaining arms 40" and an operating lever 42" similar to the retainer assembly 18', above. The retainer assembly 18" is further equipped with an operating lever blocking mechanism 180". The operating blocking mechanism 180" is slidably mounted in the retainer body 26" and is operable to selectively allow and inhibit manual operation of the operating lever 42".

Figure 15:
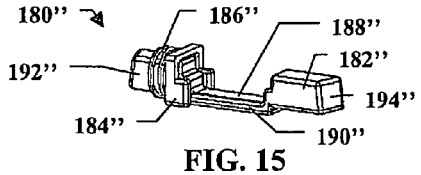
FIG. 15 is a top perspective view of the operating lever blocking mechanism of FIG. 14.
Figure 16:
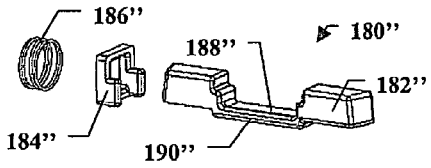
FIG. 16 is an exploded, perspective view of the operating lever blocking mechanism of FIG. 14.

Referring to FIGS. 15 and 16, the operating lever blocking mechanism 180" includes a blocking bar 182" with a blocking portion 184" and blocking mechanism biasing element 186" arranged thereon. The blocking bar 182" has a recessed area 188" defined therein. A blocking bar protrusion 190" of the blocking bar 182" engages the blocking portion 184" to ensure proper positioning relative to the recessed area 188".

Figure 17:
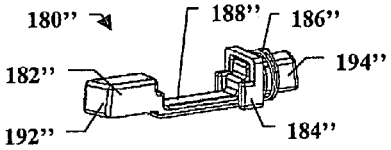
FIG. 17 is a perspective view of the operating lever blocking mechanism of FIG. 14, in an alternate configuration.

The blocking portion 184" and biasing element 186" can be removed from a first end 192" of the blocking bar 182" and arranged around a generally opposed second end 194" thereof (see FIG. 17). As a result, the operating lever blocking mechanism 180" can be installed in the retainer body 26 to accommodate either right- or left-handed users.

Figure 18:
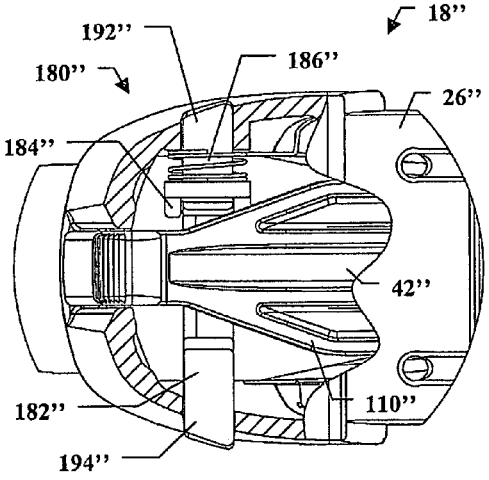
FIG. 18 is a partial top plan view of the retainer assembly of FIG. 14, with the operating lever blocking mechanism in a blocking position, with components partially cut-away to show details.

In operation, referring to FIG. 18, the operating lever blocking mechanism 180" is in the blocking position. The blocking mechanism biasing element 186" urges the blocking portion 184" under the operating lever first end 110" to inhibit depression thereof. Through engagement of the blocking portion 184" with the protrusion 190" (see FIGS. 15 and 16), the biasing element 186" also urges the second end 194" of the blocking bar 182" into a position where it is operable from outside the retainer body 26".

Figure 19:
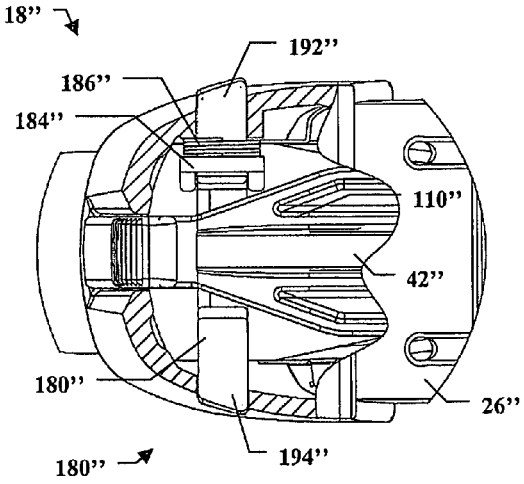
FIG. 19 is a partial top view of the retainer assembly of FIG. 14, with the operating lever blocking mechanism in a non-blocking position, with components partially cut-away to show details.

To allow depression of the operating lever first end 110", referring to FIG. 19, the blocking bar second end 194" is manually pushed inwards. Through engagement with the protrusion 190", the blocking portion 184" is moved out of the path of the operating lever first end 110" and the biasing element 186" is compressed. When the blocking bar first end 110" and blocking bar second end 194" are released, the operating lever blocking mechanism 118 will automatically return the blocking position of FIG. 18.

Figure 20:
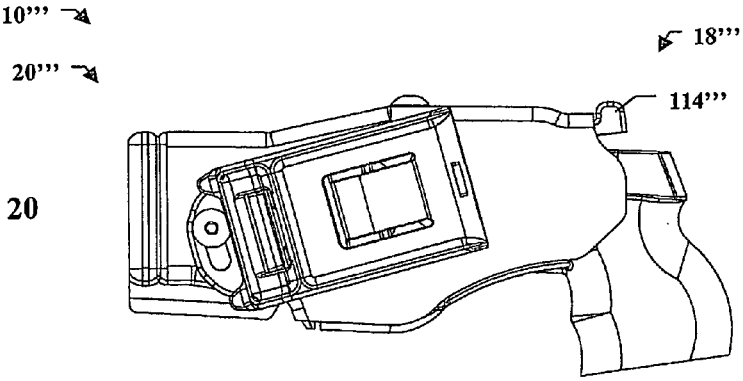
FIG. 20 is a side elevational view of a holster assembly, including a retainer assembly, according to an additional embodiment of the present invention.
Figure 22:
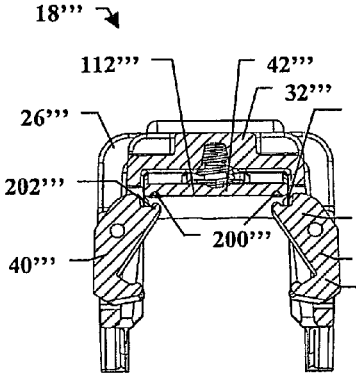
FIG. 22 is a sectional view taken along line 22-22 of FIG. 21.
Figure 21:
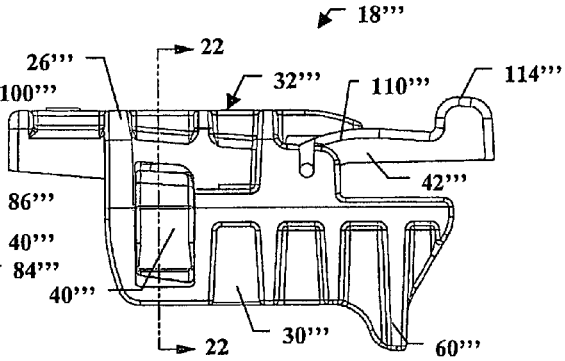
FIG. 21 is a side elevational view of the retainer assembly of FIG. 20.

Referring to FIGS. 20-22, in a further embodiment of the present invention, a holster assembly 10''' includes a retainer assembly 18''' and holster pocket 20'''. The retainer assembly 18''' includes a retainer body 26''' with sidewalls 30''' and connecting wall 32''', but without a cowling. The retainer body 26''' is releasably secured within the holster pocket 20''', with a portion of the operating lever first end 110''', including thumb lever 114''', extending outside of the holster pocket 20'''.

The retainer assembly 18''' includes retaining arms 40''', but there is not a retaining arm biasing element. Instead, recesses 200''' in the operating lever second end 112''', and corresponding protrusions 202''' from the retaining arm upper surfaces 100''', cooperate to help maintain the retainer assembly 18''' in the unlocked position when no weapon 12''' is installed.

The holster pocket 20''' is formed from a sheet of plastic material that is wrapped around onto itself and molded to generally correspond to the shape of the weapon 12''', rather than from pocket halves.

Figure 23:
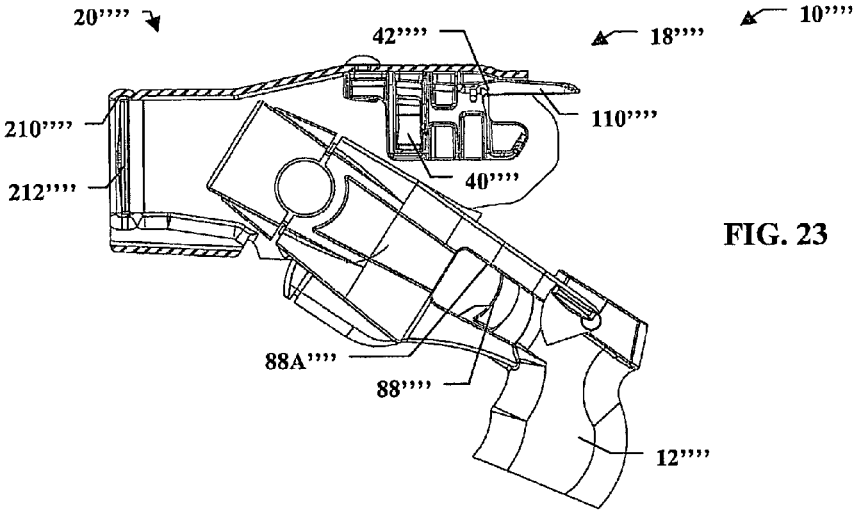
FIG. 23 is side elevational view of a holster assembly, according to another embodiment of the present invention, with components partially cut-away to show details.

Referring to FIG. 23, according to another embodiment of the present invention, a holster assembly 10'''' includes retainer assembly 18'''' and a holster pocket 20''''. The retainer assembly 18'''' includes an operating lever first end 110'''' without a generally perpendicular thumb lever. Additionally, an open end 210'''' of the holster pocket 20'''' has an end plate 212'''' arranged therein to help protect a front end of the weapon 12''''. In this embodiment, the upper surface 88A'''' of the recessed weapon area 88'''' is most clearly depicted.

The foregoing alternate embodiments are provided for exemplary and illustrative purposes, and do not constitute an exclusive list of the variations possible within the scope of the present invention. Rather, those skilled in the art will appreciate that additional modification and variations, as well as adaptations for particular circumstances, will fall within the scope of the invention herein shown and described, and of the claims appended hereto.

What is claimed is:

1. A weapon holster assembly comprising:

an elongate retainer body having an elongated axis and including:

first and second sidewalls spaced apart to accommodate a weapon upper portion therebetween; and a connecting wall bridging the first and second sidewalls;

a first retaining arm having a retaining arm first end, adapted to engage a recessed weapon area associated with the weapon upper portion, and a retaining arm second end, the first retaining arm being pivotally mounted to the retainer body between the retaining arm first and second ends; and an elongated operating lever extending parallel to the elongated axis and having an operating lever first end, adapted for manipulation by a user, and an operating lever second end, the operating lever being pivotally mounted to and between the first and second walls of and within the retainer body between the operating lever first and second ends and operable to selectively position the operating lever second end to impede and allow pivoting of the first retaining arm.

2. The holster assembly of claim 1, wherein the retainer body includes a first safety protrusion positioned to engage a weapon safety operator, such that the weapon safety operator is urged into a deactivated position when inserting the weapon upper portion between the first and second sidewalls and to retain the weapon safety operator in the deactivated position while the weapon upper portion is positioned therebetween, the retainer body further includes a second safety protrusion, the first and second safety protrusions being substantially opposed and inwardly extending from the first and second sidewalls.

3. The holster assembly of claim 1, wherein a first retaining arm opening is defined in the first sidewall, the first retaining arm being pivotally mounted therein substantially parallel to the elongated axis, the first retaining arm being pivotally mounted by a first retaining arm pivot pin inserted through aligned retaining arm pivot pin bores in the first retaining arm and in the first sidewall on opposite edges of the first retaining arm opening, the aligned bores being accessible from a front edge of the first sidewall.

4. The holster assembly of claim 1, wherein the operating lever is pivotally mounted by an operating lever pivot pin extending substantially perpendicular to the elongated axis and inserted through aligned operating lever pivot pin bores in the operating lever and in the first and second sidewalls.

5. The holster assembly of claim 1, wherein the retainer body further includes a cowling extending from adjacent rear edges of the first and second sidewalls and the connecting wall, and adapted to overlie a rear end of the weapon upper portion, the cowling having an operating lever opening defined therein, through which the operating leaver first end extends.

6. The holster assembly of claim 1, wherein the retaining arm first end of the first retaining arm includes a retaining tooth extending outwardly therefrom, the retaining tooth including a first tooth face, extending at an acute angle from the first retaining arm, and a second tooth face, extending generally perpendicularly from the first retaining arm, the retaining tooth being oriented such that the weapon upper portion will first contact the first tooth face upon insertion.

7. The holster assembly of claim 1, wherein the retaining arm second end includes a retaining arm upper surface that engages the operating lever second end when the operating lever second end is positioned to allow pivoting of the first retaining arm, a second end recess being defined in the retaining arm second end extending downwardly from the retaining arm upper surface, the second end recess engaging the operating lever second end when the operating lever second end is positioned to impede pivoting of the first retaining arm, a retaining arm biasing element urging the retaining arm upper surface under the operating lever second end when the operating lever second end is positioned to allow pivoting of the first retaining arm.

8. The holster assembly of claim 1, wherein the retaining arm second end includes a retaining arm biasing element tab extending upwardly from the retaining arm upper surface and engaging the retaining arm biasing element, the retaining arm biasing element being a single biasing wire, the biasing wire extending into a first retaining arm opening defined in the first sidewall, the first retaining arm being pivotally mounted in the first retaining arm opening, the biasing wire extending onto an upper surface of the connecting wall and being retained thereon by a biasing wire clip.

9. The holster assembly of claim 1, wherein the operating lever first end includes a thumb tab extending generally perpendicular from the operating lever, the retainer body having a cowling extending from adjacent rear edges of the first and second sidewalls and the connecting wall, and adapted to overlie a rear end of the weapon upper portion, and the cowling having an operating lever opening defined therein, through which the thumb tab extends, the operating lever opening and thumb tab being arranged such that interaction between the thumb tab and the cowling generates an audible click during use of the operating lever.

10. The holster assembly of claim 1, further including an operating lever blocking mechanism operable to selectively allow and impede pivoting of the operating lever, the operating lever blocking mechanism includes a blocking bar having a blocking portion dimensioned to impede pivoting of the operating lever and a recessed portion dimensioned to allow pivoting of the operating lever, the blocking bar being slidably mounted to the retainer body and operable to selectively align the blocking portion and the recessed portion with the operating lever, a blocking mechanism biasing element that urges the operating lever blocking mechanism into a position to impede pivoting of the operating lever.

11. The holster assembly of claim 1, further including a weapon removal biasing element adapted to act between the retainer body and a weapon upper portion to urge such weapon upper portion away from the connecting wall, a holster pocket extending from the retainer body and receiving an insertion of a front end of the weapon upper portion, the retainer body being releasably connected to the holster pocket.

12. The holster assembly of claim 11, further including an end plate arranged in a lower end of the holster pocket and protecting a front end of a weapon upper portion when inserted therein, the holster pocket being formed from two releasably connected pocket halves, at least one fastener being used to releasably connect the pocket halves also releasably connects the retainer body to the holster pocket.

13. A weapon holster assembly comprising:

a retainer body including:

first and second sidewalls spaced apart to accommodate a weapon upper portion therebetween and having respective first and second retaining arm openings defined therein;

a connecting wall bridging the first and second sidewalls; and a first safety protrusion positioned to engage a weapon safety operator, such that the weapon safety operator is urged into a "safe" position when inserting the weapon upper portion between the first and second sidewalls and to retain the weapon safety operator in the "safe" position while the weapon upper portion is positioned therebetween first and second retaining arms, each having a retaining arm first end, adapated adapted to engage at least one recessed weapon area associated with the weapon upper portion, and a retaining arm second end, the first and second retaining arms being pivotally mounted in the respective first and second retaining arm openings between the retaining arm first and second ends;

an operating lever having an operating lever first end, including a thumb tab extending generally perpendicular from the operating lever, and an operating lever second end, the operating lever being pivotally mounted to the first and second sidewalls between the operating lever first and second ends and operable to selectively position the operating lever second end to impede and allow pivoting of the first and second retaining arms;

an operating lever biasing element that urges the operating lever into engagement with the first and second retaining arm second ends; a holster pocket extending from, and releasably connected to, the retainer body and allowing insertion of a front end of the weapon upper portion therein.

14. The holster assembly of claim 13, wherein the retainer body further includes a cowling extending from adjacent rear edges of the first and second sidewalls and the connecting wall, and adapted to overlie a rear end of the weapon upper portion, the cowling having an operating lever opening defined therein, through which the operating lever first end extends.

15. The holster assembly of claim 13, wherein each retaining arm first end includes a retaining tooth extending outwardly therefrom, the retaining tooth including a first tooth face, extending at an acute angle from the retaining arm, and a second tooth face, extending generally perpendicularly from the first retaining arm, the retaining tooth being oriented such that the weapon upper portion will first contact the first tooth face upon insertion, and each retaining arm second end further includes a retaining arm upper surface that engages the operating lever second end when the operating lever second end is positioned to allow pivoting of the retaining arms.

16. The holster assembly of claim 13, further including a retaining arm biasing element that urges the retaining arm upper surfaces under the operating lever second end when the operating lever second end is positioned to allow pivoting of the retaining arms, each retaining arm second end including a retaining arm biasing element tab extending upwardly from the retaining arm upper surface and engaging the retaining arm biasing element, the biasing element being a single biasing wire that extends into the retaining arm openings and across an upper surface of the connecting wall and retained thereon by a biasing wire clip.

17. The holster assembly of claim 13, wherein the holster pocket is formed from two releasably connected pocket halves and at least one fastener used to releasably connect the pocket halves also releasably connects the retainer body to the holster pocket.

* * * * *